US012022873B2

(12) United States Patent
Shimizu

(10) Patent No.: US 12,022,873 B2
(45) Date of Patent: Jul. 2, 2024

(54) SMOKING TOOL

(71) Applicant: Intellectual Discovery Co., Ltd., Seoul (KR)

(72) Inventor: Kazuhiko Shimizu, Kobe (JP)

(73) Assignee: Intellectual Discovery Co., Ltd. (KR)

( * ) Notice: Subject to any disclaimer, the term of this patent is extended or adjusted under 35 U.S.C. 154(b) by 0 days.

(21) Appl. No.: 18/126,122

(22) Filed: Mar. 24, 2023

(65) Prior Publication Data

US 2023/0292842 A1 Sep. 21, 2023

Related U.S. Application Data

(63) Continuation of application No. 17/294,781, filed as application No. PCT/KR2019/015899 on Nov. 19, 2019.

(30) Foreign Application Priority Data

Nov. 19, 2018 (JP) ..... 2018-216277
Dec. 28, 2018 (JP) ..... 2018-246902

(51) Int. Cl.
*A24F 40/46* (2020.01)
*A24F 40/20* (2020.01)

(52) U.S. Cl.
CPC ..... *A24F 40/46* (2020.01); *A24F 40/20* (2020.01)

(58) Field of Classification Search
CPC ..... A24F 40/46; A24F 40/20
USPC ..... 131/329
See application file for complete search history.

(56) References Cited

U.S. PATENT DOCUMENTS

| | | | |
|---|---|---|---|
| 62,802 A | 3/1867 | Andrews | |
| 1,730,033 A | 10/1929 | Faranda | |
| 2,024,865 A | 12/1935 | McArdle | |
| 5,726,421 A | 3/1998 | Grier et al. | |
| 8,897,628 B2 | 11/2014 | Conley et al. | |
| 10,064,434 B2 | 9/2018 | Zitzke et al. | |
| 10,104,909 B2 | 10/2018 | Han et al. | |
| 10,602,774 B2 | 3/2020 | Hawes et al. | |
| 10,918,136 B2 | 2/2021 | Reevell | |
| 11,229,235 B2 | 1/2022 | Saygili et al. | |
| 11,653,699 B2 | 5/2023 | Blattler et al. | |
| 2013/0014772 A1 | 1/2013 | Liu | |
| 2014/0013126 A1* | 1/2014 | Allen-Ware | H04L 12/6418 713/300 |

(Continued)

FOREIGN PATENT DOCUMENTS

| | | |
|---|---|---|
| JP | 3392138 | 3/2003 |
| JP | 3392138 B2 | 3/2003 |

(Continued)

OTHER PUBLICATIONS

Office Action Issued by Korean Office Action 10-2021-7015789 Issued May 26, 2023.
European Office Action 19887209.5, Issued Dec. 15, 2023.

*Primary Examiner* — Gary F Paumen
(74) *Attorney, Agent, or Firm* — The Belles Group, P.C.

(57) ABSTRACT

A smoking tool according to the present invention includes: a heater configured to heat tobacco leaves inserted into the tool; and an atomizer configured to generate electronic cigarette smoke, in which the atomizer generates the electronic cigarette smoke when a smoker inhales air, such that the smoker inhales the smoke to which nicotine or tobacco flavor generated by heating the tobacco leaves is added.

9 Claims, 7 Drawing Sheets

(56) References Cited

U.S. PATENT DOCUMENTS

| | | | | |
|---|---|---|---|---|
| 2015/0296887 | A1* | 10/2015 | Zhu | A24F 40/485 131/329 |
| 2016/0073694 | A1* | 3/2016 | Liu | A24F 40/46 131/329 |
| 2016/0135504 | A1* | 5/2016 | Li | A61M 15/06 392/395 |
| 2016/0192709 | A1* | 7/2016 | Liu | A24F 1/30 131/329 |
| 2016/0227841 | A1 | 8/2016 | Li et al. | |
| 2016/0249683 | A1* | 9/2016 | Li | H05B 3/14 131/329 |
| 2016/0324216 | A1 | 11/2016 | Li et al. | |
| 2016/0345630 | A1 | 12/2016 | Mironov | |
| 2016/0353805 | A1 | 12/2016 | Hawes et al. | |
| 2017/0071251 | A1 | 3/2017 | Goch | |
| 2017/0202265 | A1 | 7/2017 | Hawes et al. | |
| 2017/0347706 | A1 | 12/2017 | Aoun et al. | |
| 2018/0169357 | A1 | 6/2018 | Reevell | |
| 2018/0360122 | A1 | 12/2018 | Aoun et al. | |
| 2020/0275694 | A1 | 9/2020 | Hawes et al. | |
| 2020/0297029 | A1* | 9/2020 | Shimizu | A24D 1/045 |
| 2020/0359688 | A1 | 11/2020 | Jang et al. | |
| 2020/0375249 | A1 | 12/2020 | Yanez | |
| 2021/0106051 | A1 | 4/2021 | Han et al. | |
| 2021/0235770 | A1 | 8/2021 | Uthurry | |
| 2021/0361890 | A1 | 11/2021 | Li et al. | |
| 2022/0007721 | A1 | 1/2022 | Aoun et al. | |

FOREIGN PATENT DOCUMENTS

| | | | |
|---|---|---|---|
| JP | 5272200 | | 8/2013 |
| JP | 5272200 | B2 | 8/2013 |
| JP | 2013150593 | A | 8/2013 |
| JP | 2014117247 | A | 6/2014 |
| JP | 5854394 | | 2/2016 |
| JP | 5854394 | B2 | 2/2016 |
| JP | 2017511703 | A | 4/2017 |
| JP | 2017127300 | | 7/2017 |
| JP | 2017127300 | A | 7/2017 |
| JP | 2018516551 | | 6/2018 |
| JP | 2018516551 | A | 6/2018 |
| JP | 2018174802 | A | 11/2018 |
| JP | 2018174880 | | 11/2018 |
| JP | 2018174880 | A | 11/2018 |
| JP | 2019041736 | | 3/2019 |
| JP | 2019041736 | A | 3/2019 |
| JP | 2019041736 | A1 | 3/2019 |
| KR | 20090100400 | A | 9/2009 |
| KR | 20120051570 | | 5/2012 |
| KR | 20120051570 | A | 5/2012 |
| KR | 20130008957 | | 1/2013 |
| KR | 20130008957 | A | 1/2013 |
| KR | 20160031801 | A | 3/2016 |
| KR | 20170128354 | | 11/2017 |
| KR | 20170128354 | A | 11/2017 |
| KR | 20180005212 | | 1/2018 |
| KR | 20180005212 | A | 1/2018 |
| KR | 10-2018-0085365 | A | 7/2018 |
| KR | 20-0189244 | Y1 | 7/2020 |
| WO | WO2014020953 | A1 | 2/2014 |
| WO | WO2016062777 | | 4/2016 |
| WO | WO2016062777 | A1 | 4/2016 |
| WO | WO2016070553 | | 5/2016 |
| WO | WO2016070553 | A1 | 5/2016 |
| WO | WO2016179376 | | 11/2016 |
| WO | WO2016179376 | A1 | 11/2016 |
| WO | WO2017141017 | | 8/2017 |
| WO | WO2017141017 | A1 | 8/2017 |
| WO | WO2018/114263 | A1 | 6/2018 |
| WO | WO2018114312 | A | 6/2018 |
| WO | WO2018189195 | | 10/2018 |
| WO | WO2018189195 | A1 | 10/2018 |
| WO | WO2018224677 | A2 | 12/2018 |

* cited by examiner

SMOKING TOOL

CROSS-REFERENCE TO RELATED APPLICATIONS

This application is a continuation of U.S. patent application Ser. No. 17/294,781, filed on May 18, 2021, which is a U.S. national stage application under 35 U.S.C. § 371 of PCT Application No. PCT/KR2019/015899, filed Nov. 19, 2019, which claims the benefit of Japanese Patent Application No. 2018-246902, filed Dec. 28, 2018, and Japanese Patent Application No. 2018-216277, filed Nov. 19, 2018, the disclosures of all of which are incorporated herein by reference in their respective entireties, for all purposes.

TECHNICAL FIELD

The present invention relates to a heating type smoking tool which heats tobacco leaves with a heater to enable a smoker to inhale nicotine evaporated from the tobacco leaves, and more particularly, to a smoking tool mounted with an atomizer for an electronic cigarette, such that when the smoker inhales smoke from a filter of a filter-attached cigarette inserted into the tool or from a mouthpiece attached to a tobacco leaf insertion tube into which the tobacco leaves are inputted, the smoker may inhale nicotine and tobacco flavor generated by heating the tobacco leaves and inhale vapor (smoke) generated by the atomizer. In this case, the atomizer for an electronic cigarette uses a liquid containing glycerin, propylene glycol, or the like as main substances and generates vapor (smoke) by heating the liquid with a heater disposed in the atomizer. Hereinafter, in the present application, the vapor (smoke) is referred to as electronic cigarette smoke.

BACKGROUND ART

A heated tobacco product is a product such as IQOS launched by Philip Morris in Japan in 2014, or Glo launched on trial by BAT in 2016 in Sendai. Each of the heated tobacco products has an exclusive smoking tool into which an exclusive filter-attached cigarette is inserted, and nicotine, tobacco flavor, and smoke are generated by heating tobacco leaves with a heater disposed in the tool. When tobacco leaves of a typical filter-attached cigarette, which allows a smoker to smoke by burning the tobacco leaves, are heated by a heater, nicotine and tobacco flavor are somewhat released, but smoke is hardly generated. As the tobacco leaves of the exclusive filter-attached cigarette, there are used tobacco leaves that have been subjected to a special chemical treatment in order to generate smoke by being heated by the heater. A cigarette for the IQOS is called a 'Heat Stick' and is about 7.2 φ in diameter and about 45 mm in length. A cigarette for the Glo is called 'Neo-Stick' and is about 5.2 φ in diameter and about 83 mm in length. All the filter parts of the filter-attached cigarettes have many gaps in order to transfer nicotine, tobacco flavor, or smoke, which is generated by heating the tobacco leaves, to a smoker's mouth without absorbing the nicotine, the tobacco flavor, or the smoke. In addition, there is widely used a typical filter-attached cigarette that is about 8.0 φ in diameter and used by being burnt.

DOCUMENTS OF RELATED ART

Patent Document

Patent Document 1: Japanese Patent No. 5854394
Patent Document 2: Japanese Patent No. 3392138

Patent Document 3: Japanese Patent No. 5272200
Patent Document 4: Japanese Patent Application Laid-Open No. 2019-41736
Patent Document 5: Japanese Patent Application Laid-Open No. 2017-127300

DISCLOSURE

Technical Problem

The heated tobacco product disclosed in Patent Document 1 or Patent Document 2 is being sold under the name of IQOS. The heated tobacco product disclosed in Patent Document 1 or Patent Document 2 is being currently sold under the name of IQOS. In this product, when the filter-attached cigarette for the IQOS, which is the Heat Stick, is inserted into a holder, a heating heater disposed in the holder is inserted into almost a center of a tobacco part of the Heat Stick, and the tobacco leaves are heated by the heater, such that nicotine, tobacco flavor, and smoke are generated. In the case of the product, which is currently sold under the name of Glo, when a filter-attached cigarette for Glo, which is Neo-Stick, is inserted into a main body, the filter-attached cigarette is inserted into a cylindrical heater disposed in the main body, and the tobacco leaves are heated from an outer circumferential portion thereof by the cylindrical heater, such that nicotine, tobacco flavor, and smoke are generated.

The tobacco leaves, which are used for the filter-attached cigarettes of these products, are subjected to chemical treatment so that nicotine, tobacco flavor, and smoke are generated from the tobacco leaves when the tobacco leaves are heated at a temperature of about 200° C. to 300° C.

When the smoker smokes using the filter-attached cigarette by setting the heating temperature to about 200° C., the smoker may enjoy mild tobacco flavor, but the amount of generated smoke is very small. In contrast, when the heating temperature is set to about 300° C. in order to increase the amount of smoke to be generated, tobacco flavor, which tastes like burnt flavor, is generated even though the amount of smoke is increased. For this reason, the smoker cannot smoke with tobacco flavor suitable for his/her preference and the amount of smoke suitable for his/her preference. Because a predetermined heating temperature is set in the smoking tool, the smoker cannot enjoy smoking at his/her preferred temperature.

In smoking, the generated smoke is one of the important smoking elements, and when the smoke passes through the innermost side of the throat, the brain feels the smoking. In consideration of this fact, the present inventor has invented a smokeless smoking tool in which an atomizer for an electronic cigarette disclosed in Patent Document 5 may be mounted. However, the smokeless smoking tool has a mechanism in which nicotine and tobacco flavor generated by heating tobacco leaves are transferred to a smoker's mouth after passing through the atomizer of the electronic cigarette. However, because the smoker feels that the nicotine and tobacco flavor generated by heating the tobacco leaves pass through the liquid in the electronic cigarette and the smoker absorbs the nicotine and tobacco flavor, the reputation is not so good.

Furthermore, because these cigarettes have the almost the same price as the typical filter-attached cigarette that allows the smoker to smoke by burning the tobacco leaves, the smoker's economic burden is heavy because a separate heating tool is required.

Furthermore, because the Heat Stick or the Neo-Stick has the almost the same price as the typical filter-attached cigarette that allows the smoker to smoke by burning the tobacco leaves, the smoker's economic burden is heavy because a separate heating tool is required.

There is also a product called Ploom TECH sold by JT which is not the heated tobacco product. FIG. 9 illustrates a configuration of this product (a power source for supplying power is omitted). The smoke generating part 300 has therein a mechanism for generating electronic cigarette smoke and receives power from a connector 302. The smoker inserts a capsule 301, which is filled with small tobacco leaves, into the smoke generating part 300 and inhales air from a mouthpiece 303. When the smoker inhales the air, outside air is introduced from the power source (not illustrated). In this case, because the outside air passes through a small hole, low sound is generated. When a microphone mounted in the power source receives the sound, power of an embedded rechargeable battery is supplied to the smoke generating part. The outside air passes through the small hole formed in the power source, such that passing sound is generated. When the microphone mounted in the power source receives the passing sound, power of the embedded rechargeable battery is supplied to the smoke generating part. When the smoker inhales the air, the power is supplied to an electronic cigarette smoke generating mechanism in the smoke generating part 300 from the power source via the connector 302, such that the electronic cigarette smoke is generated. When the outside air and the smoke pass through the inside the capsule 301, the tobacco flavor from the small tobacco leaves is added to the smoke, and the smoke is transferred to the smoker's mouth. Because the tobacco leaves are not in a heated state and almost no nicotine is added, the product is considered as being an electronic cigarette in the market and as being a product different from the heated tobacco product from which the smoke may inhale nicotine.

Technical Solution

In order to solve the problem, the present inventor has developed a smoking tool including: a heating tube part having a heater for heating tobacco leaves; and an atomizer for an electronic cigarette. When a smoker inserts a filter-attached cigarette for an IQOS into the tool and inhales the air from the filter part, the smoker may enjoy the nicotine and tobacco flavor which are generated by heating the tobacco leaves and to which the electronic cigarette smoke generated by the atomizer is added. Further, the smoker may individually set and enjoy the amount of nicotine and tobacco flavor and the amount of electronic cigarette smoke.

Further, a portion made by cutting, by about ⅕, the typical filter-attached cigarette, which allows the smoker to smoke by burning the tobacco leaves, is inserted into the tool or leaf tobacco for a pipe is inserted into the tobacco leaf insertion and inserted into the tool, such that the smoker may enjoy the nicotine and tobacco flavor from the tobacco leaves to which the electronic cigarette smoke is added. The above-mentioned smoking method greatly reduces the price of cigarettes.

Further, a portion made by cutting, by about ⅕ in length, the typical filter-attached cigarette, which allows the smoker to smoke by burning the tobacco leaves, is inserted into the tool or tobacco leaves or leaf tobacco for a pipe is inserted into the tobacco leaf insertion and inserted into the tool, such that the smoker may enjoy the nicotine and tobacco flavor from the tobacco leaves to which the electronic cigarette smoke is added. It can be ascertained that the above-mentioned smoking method greatly reduces the price of cigarette.

A smoking tool according to an embodiment of the present invention includes: a heater configured to heat tobacco leaves inserted into the tool; and an atomizer 94 configured to generate electronic cigarette smoke, in which the atomizer 94 generates the electronic cigarette smoke when a smoker inhales air, such that the smoker inhales the smoke to which nicotine or tobacco flavor generated by heating the tobacco leaves is added.

According to the embodiment, in the smoking tool, as the atomizer 94 is tightly pressed against a heating tube part 91 by a force of a spring 203, air may not leak from a connection portion between the atomizer 94 and the heating tube part 91.

According to the embodiment, in the smoking tool, a tobacco leaf retaining mechanism for a Heat Stick and a tobacco leaf retaining mechanism for a tobacco leaf insertion tube may be provided, and the tobacco leaf retaining mechanisms may be set on the configuration 5, such that the smoking tool is used for both the Heat Stick and the tobacco leaves.

A smoking tool according to another embodiment of the present invention includes: a heater configured to heat inserted tobacco leaves; and an atomizer 94 configured to generate electronic cigarette smoke, in which a smoker inhales the smoke which is generated by the atomizer and to which nicotine or tobacco flavor generated by heating the tobacco leaves with the heater is added.

According to the embodiment, in the smoking tool, a supply of power to the atomizer 94 may be performed from a connector having a spring 203.

According to the embodiment, in the smoking tool, an insertion portion corresponding to different types of tobacco may be mounted.

Advantageous Effects

In order to solve the problem, the present inventor has developed a smoking tool including: a heating tube part having a heater for heating tobacco leaves; and an atomizer for an electronic cigarette. When a smoker inserts a filter-attached cigarette for an IQOS into the tool and inhales the air from the filter part, the smoker may enjoy the nicotine and tobacco flavor which are generated by heating the tobacco leaves and to which the electronic cigarette smoke generated by the atomizer is added. Further, the smoker may individually set and enjoy the amount of nicotine and tobacco flavor and the amount of electronic cigarette smoke.

Further, a portion made by cutting, by about ⅕, the typical filter-attached cigarette, which allows the smoker to smoke by burning the tobacco leaves, is inserted into the tool or leaf tobacco for a pipe is inserted into the tobacco leaf insertion and inserted into the tool, such that the smoker may enjoy the nicotine and tobacco flavor from the tobacco leaves to which the electronic cigarette smoke is added. The above-mentioned smoking method greatly reduces the price of cigarette.

EXPLANATION OF REFERENCE NUMERALS AND SYMBOLS

91: Heating tube part
93: Tobacco retaining part A
94: Atomizer
95: Tobacco retaining part B
203: Spring

MODE FOR INVENTION

Figure 8:
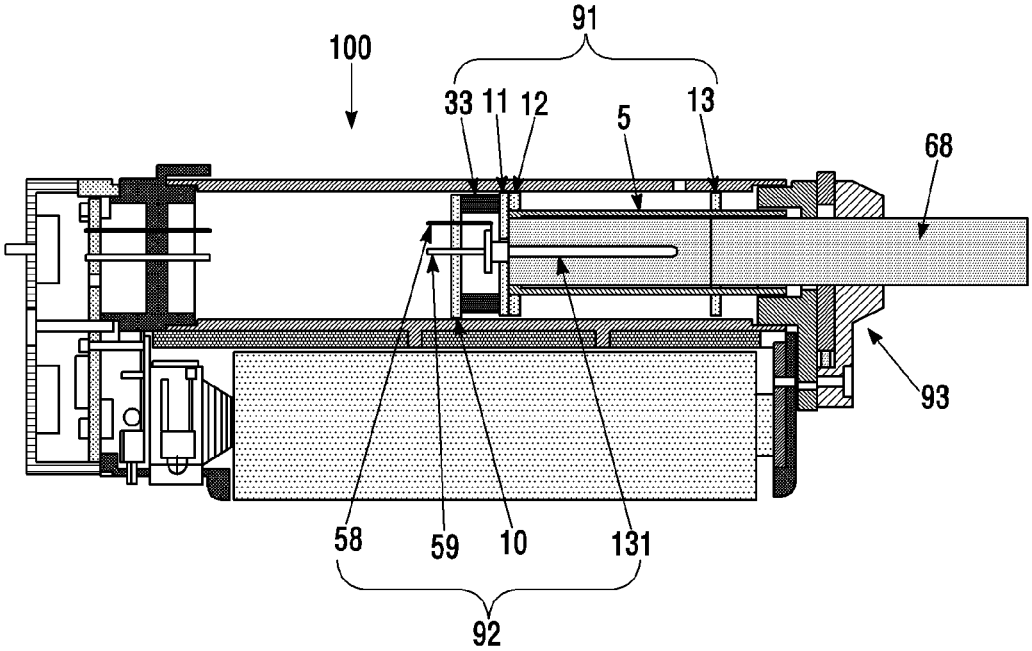
FIG. 8 is an axial cross-sectional view illustrating a state in which a Heat Stick is inserted into a smokeless smoking tool disclosed in Patent Document 4.
Figure 14:
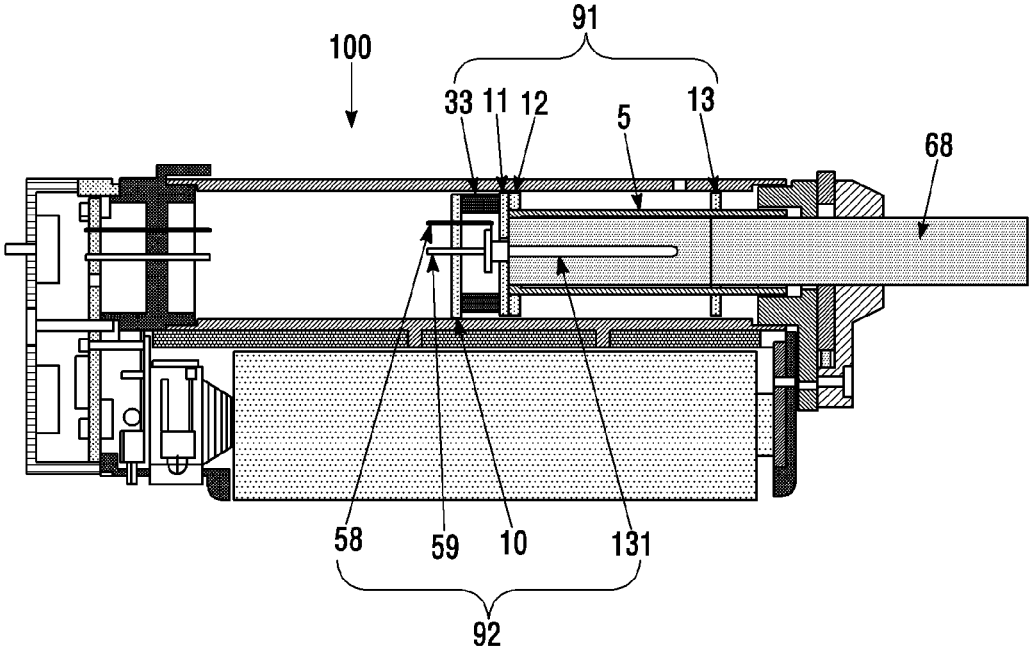
FIG. 14 is an axial cross-sectional view illustrating a state in which a Heat Stick is inserted into a smokeless smoking tool disclosed in Patent Document 4.

FIGS. 8 and 14 are axial cross-sectional views of a smokeless smoking tool 100 disclosed in Patent Document 4, and the smokeless smoking tool 100 includes a heating tube part 91, a heater part 92, a tobacco retaining part 93, a rechargeable battery part, a drive circuit part, and the like. Referring to the axial cross-sectional view of the smokeless smoking tool 100 disclosed in Patent Document 4, the smokeless smoking tool 100 includes the heating tube part 91, the heater part 92, the tobacco retaining part, the rechargeable battery part, the drive circuit part, and the like. Hereinafter, only the components related to the present invention will be described. The heating tube part 91 includes three P-plates, an inner tube 5 (an Al tube or a glass tube), and pedestals 33. The P-plate D 13 and the P-plate C 12 each have a hole slightly larger than an outer diameter of the inner tube 5, and the inner tube 5 is tightly fitted into the holes. The P-plate B 11 has a hole positioned at a center thereof, and a heater 131 passes through the hole. The two pedestals 33 each having a screw hole are vertically fixed in order to mount and fix the heater part 92. In some instances, the P-plate C 12 and the P-plate B 11 may be bonded together or formed into one P-plate. Further, between the P plate D 13 and the P plate B 11, two to four pins may be used to prevent the positional relationship between the P plate D 13 and the P plate B 11 from being changed.

Even though the heater part 92 is described in Patent Document 4, the heater part 92 related to the present invention will be described again. The heater part 92 includes the heater 131, the P-plate A 10, the pin D 59, and the pin C 58. However, the heater 131 used in the present invention is made by attaching a resistive material to a surface of a ceramic rod by printing and has a structure different from that disclosed in Patent Document 4, but the heater 131 has the same function as the heater disclosed in Patent Document 4.

The smokeless smoking tool 100 disclosed in Patent Document 4 uses the cigarette for the IQOS, which is the Heat Stick, and is configured to allow a smoker to set a heating temperature or a heating time for the tobacco leaves to a preferred temperature or time by using a slide switch, but a change in heating temperature or heating time cannot be performed by the IQOS.

When the smoker smokes by using the smokeless smoking tool 100 disclosed in Patent Document 4 and inserting the Heat Stick, the smoker may change the heating temperature. Therefore, the smoker may smoke at a temperature preferred by the smoker, the amount of nicotine and tobacco flavor to be generated or the amount of smoke to be generated cannot be individually controlled. That is, when the heating temperature decreases, the amount of generated nicotine decreases, and tobacco flavor becomes mild, but the amount of generated smoke decreases. On the contrary, when the heating temperature increases, the amount of generated smoke increases, but the generated nicotine is less decomposed, such that bitter and burnt tobacco flavor is generated.

Figure 1:
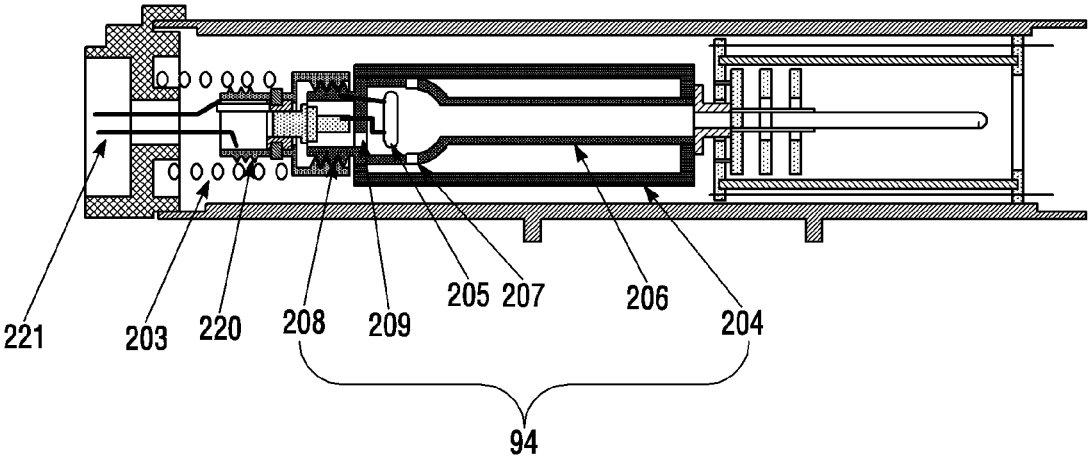
FIG. 1 is an axial cross-sectional view illustrating an interior of a configuration of a smoking tool according to the present invention.

In order to solve the problem, the present inventor has developed the smoking tool 100 according to the present invention illustrated in FIG. 1 which is an axial cross-sectional view illustrating the interior of the configuration of the smoking tool 100. However, the tobacco retaining part A 93 or the tobacco retaining part B 95 is omitted from FIGS. 1, 3, 6, 10, and 12. That is, the smoking tool 100 according to the present invention uses the combination of the tobacco retaining part A 93 illustrated in FIGS. 3 and 10 and the tobacco retaining part B 95 illustrated in FIGS. 6 and 12. The charging part, the drive circuit part, the switch part, and the rear cover are omitted, but the product almost identical to the product illustrated in FIG. 8 is used. Further, in FIG. 1, the atomizer 94, the 510-connector 220, and the spring 203 are newly added. One of the two types of tobacco retaining parts including the tobacco retaining part A 93 and the tobacco retaining part B 95 is used for the Heat Stick, and another is used for the tobacco leaves.

Figure 4:
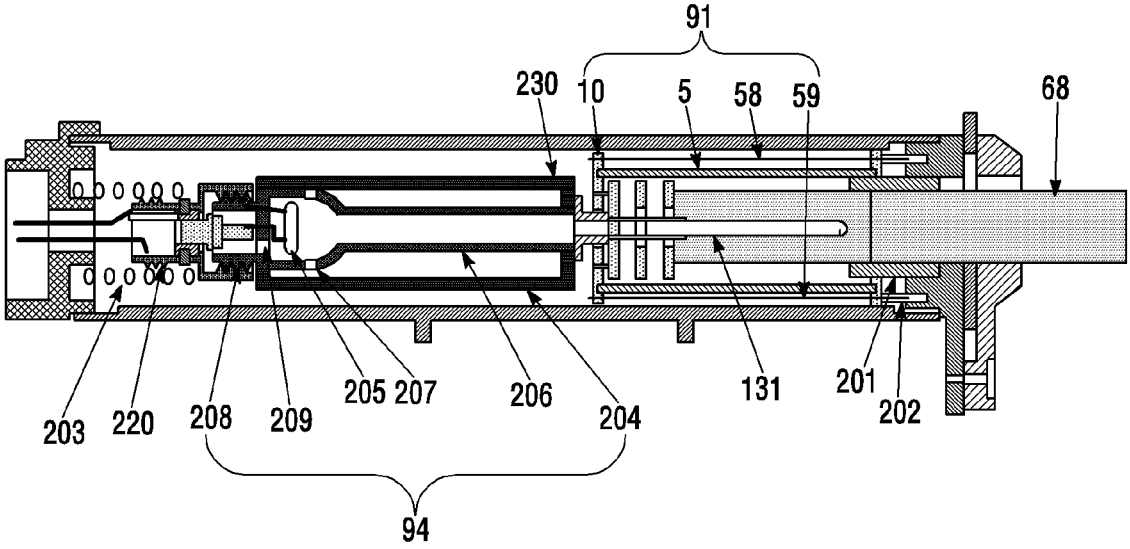
FIG. 4 is an axial cross-sectional view illustrating a state in which the tobacco retaining part A is mounted on the configuration of the smoking tool according to the present invention and a Heat Stick is inserted into the configuration of the smoking tool.
Figure 11:
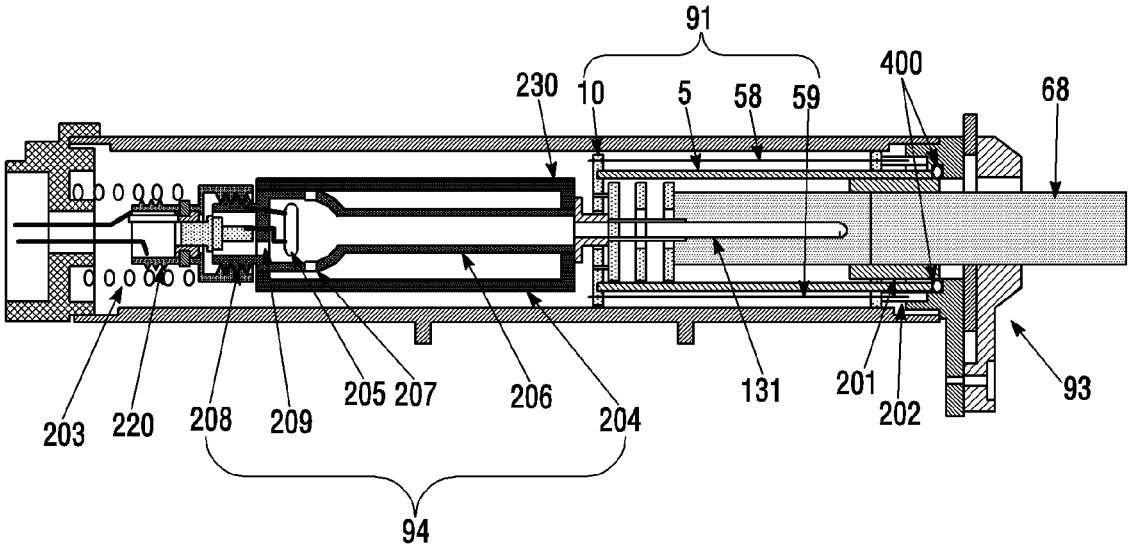
FIG. 11 is an axial cross-sectional view illustrating a state in which the tobacco retaining part A is mounted on the configuration of the smoking tool according to the present invention and the Heat Stick is inserted into the configuration of the smoking tool.

FIGS. 4 and 11 are axial cross-sectional views illustrating states in which a Heat Stick 68 is inserted into the smoking tool according to the present invention in which the tobacco retaining part A is mounted. Research was additionally conducted to make a configuration in which when the smoker inhales air from a filter part of the Heat Stick 68 in this state, the smoke generated by the atomizer 94 passes through the heating tube part 91 and the Heat Stick 68 and then enters the smoker's mouth.

FIGS. 4 and 11 are axial cross-sectional views illustrating states in which the Heat Stick 68 is inserted into the smoking tool according to the present invention in which the tobacco retaining part A 93 is mounted. In this state, when the smoker inhales the air from the filter part of the Heat Stick 68 and pushes a smoke generating switch (not illustrated), the smoke is generated from the atomizer 94, the smoke passes through the heating tube part 91 and the Heat Stick 68, and the smoke and the generated nicotine and tobacco flavor enter the smoker's mouth. In addition, instead of the smoke generating switch, there may be used a configuration in which smoke may be generated when a microphone receives sound that occurs when outside air flows as the smoker sucks the cigarette. However, it is not necessary to describe this configuration. When the smoker inhales the smoke, the smoke, together with air introduced from an air inlet 209 of the atomizer, passes through a portion of the atomizer 94 where the heater 205 exists. The smoke passes through the heating tube part 91 and the Heat Stick 68 and then enters the smoker's mouth. If there is a gap in this route and outside air may be introduced into the gap, a pressure in a middle tube 206 in the atomizer is not decreased even though the smoker inhales the air. As a result, the generation of the smoke is inhibited and even the generated smoke does not reach the smoker's mouth.

Figure 2:
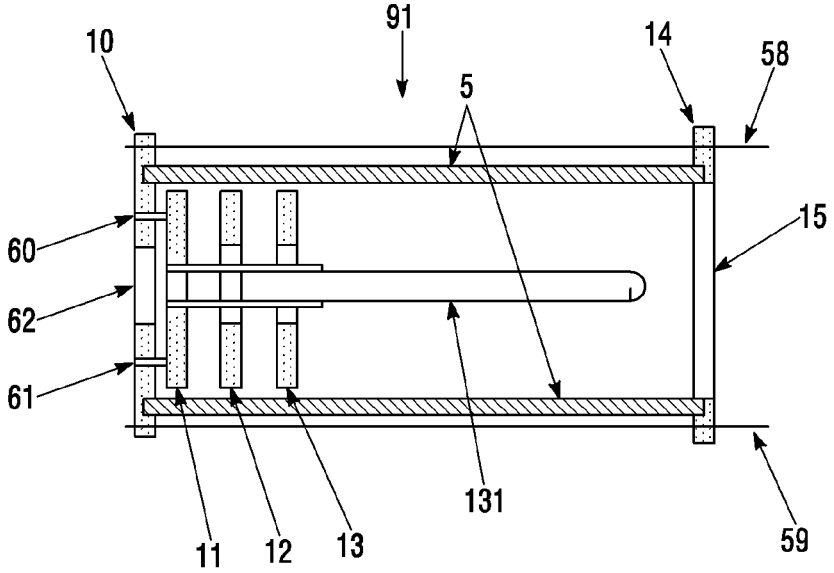
FIG. 2 is an axial cross-sectional view of a heating tube used for the smoking tool according to the present invention.

FIG. 2 is an axial cross-sectional view of the heating tube part 91 used for the smoking tool according to the present invention. The heating tube part 91 has the P-plate A 10 disposed at an end of the inner tube 5 (a cylindrical tube such as an AL tube or a glass tube), and the P-plate E 14 disposed at a position close to a tip portion of the inner tube. These three components are connected with the pin D 59 and the pin C 58 and fixed by the heat-resistant bonding agent. Further, the two pins D and C also serve as connection pins for supplying power to the heater 131 from the outside. The heater 131 and the three P-plates (the P-plate B11, the P-plate C12, and the P-plate D13) are disposed in the heating tube part 91, and a wire C 60 and a wire D 61 are provided to supply power to the heater 131 from the pin C 58 and the pin D 59. A hole 62 is formed in the P-plate A 10, and the smoke is introduced into the hole 62 from the atomizer 94. When an insertion port 15 and the hole 62 are closed, the heating tube part 91 has no path through which the air is introduced. The present application discloses the heating tube part including the inner tube and the two P-plates. However, for example, the heating tube part may be configured by integrating the inner tube and the two P-plates using PTFE resin having heat resistance, but it is not necessary to describe this configuration. The present application discloses the heating tube part including the inner tube and the two P-plates. However, for example, the heating tube part may be configured by integrating the inner tube and the two P-plates using PTFE resin having heat resistance, but it is not necessary to describe this configuration.

Figure 3:
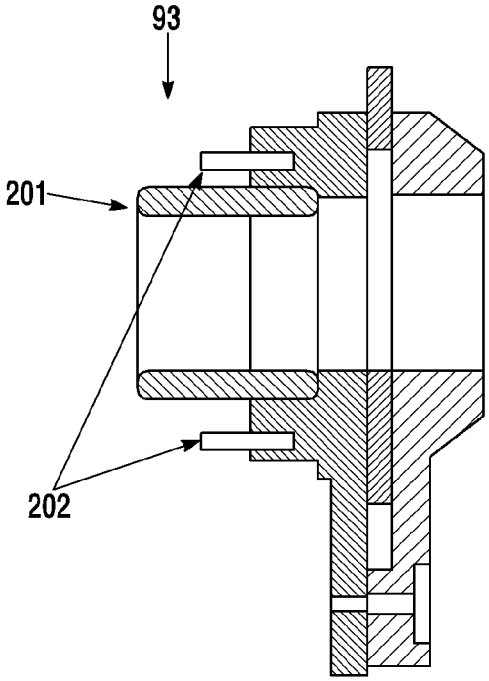
FIG. 3 is an axial cross-sectional view of a tobacco retaining part A of the smoking tool according to the present invention.
Figure 10:
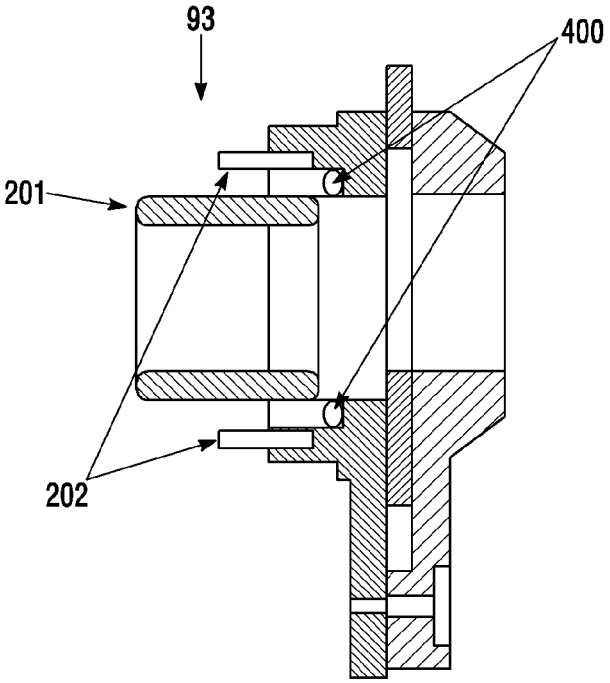
FIG. 10 is an axial cross-sectional view of the tobacco retaining part A of the smoking tool according to the present invention.

FIGS. 3 and 10 are axial cross-sectional views of the tobacco retaining part 93 used in the present invention. Because the tobacco retaining part 93 is described in Patent Document 4, a detailed description thereof will be omitted, but the tobacco retaining part 93 has an insertion portion 201 disposed toward the inner tube, and connectors 202. As illustrated in FIGS. 4 and 11, the insertion portion 201 disposed toward the inner tube 5 is configured to be tightly fitted with the inner tube 5 of the heating tube part 91.

FIGS. 3 and 10 are axial cross-sectional views of the tobacco retaining part A 93 used in the present invention. Because the tobacco retaining part A 93 is described in Patent Document 4, a detailed description thereof will be omitted, but the tobacco retaining part A 93 has an insertion portion 201 disposed toward the inner tube, connectors 202, and a silicone O-ring that adjoins an end surface of the inner tube 5. As the O-ring is inserted, an inflow of outside air from the end surface of the inner tube 5 is blocked. As illustrated in FIGS. 4 and 11, the insertion portion 201 disposed toward the inner tube 5 is configured to be inserted while retaining a small gap together with the inner tube 5 of the heating tube part 91. In addition, the connectors 202 are connected to the control circuit (not illustrated), the pins C and D of the heating tube part 91 are inserted, and the power is supplied to the heater 131 from the control circuit.

Next, the atomizer 94 illustrated in FIG. 1 will be described. The atomizer used in the present application is an atomizer for a general electronic cigarette. The atomizer is identical to an atomizer being used and is not special. The atomizer illustrated in FIG. 1 includes a convex 510-connector 208 configured to receive power for the heater 205 of the atomizer, a container 204 configured to accommodate a liquid for an electronic cigarette, and an inner tube 206 configured to serve as a passageway for air and smoke, and an atomizer heater 205. When the liquid for an electronic cigarette is putted into the container 204, the liquid in the container 204 may be moved to the periphery of the heater 205 of the atomizer from the hole 207. When the power is supplied to the heater 205 from the convex 510-connector 208, the heater 205 is heated, the liquid at the periphery of the heater 205 is heated, and the smoke is generated. In this case, when the smoker inhales air from the tip portion of the inner tube 206, a negative pressure is formed in the inner tube, outside air is introduced into the inner tube from the air inlet 209, and the outside air, together with the generated smoke, is transferred to the smoker's mouth. The supply of power to the atomizer is performed via the convex 510-connector 208 from the 510-connector 220 connected to the control circuit with a wire 221.

Referring to FIGS. 4 and 11, the atomizer 94 is tightly pressed against the heating tube part 91 by the spring 203 with a bushing 230 interposed therebetween, such that the atomizer 94 and the heating tube part 91 are connected so that the air in the inner tube 206 of the atomizer 94 and the internal space of the inner tube 5 of the heating tube part 91 does not leak. The bushing 230 is made of heat-resistant resin such as PTFE in order to prevent heat of the P-plate A 10 heated by the heat of the heater 131 from being transferred to the atomizer. In addition, the insertion portion 201 of the tobacco retaining part 93, which is disposed toward the inner tube, is tightly fitted with the inner tube 5 of the heating tube part 91 and configured such that the air does not leak from the fitted portion.

Further, three silicone O-rings 1 are sometimes used to prevent a leakage of air from this portion. Further, although not illustrated, the tip portion of the container 204 of the atomizer 94 may be covered with thermally shrinkable tube, and the thermally shrinkable tube is an effective means that is thermally shrunk to prevent the air from leaking between the tip portion and the bushing 230.

When the smoker inhales the air from the filter part of the Heat Stick 68 in the state illustrated in FIGS. 4 and 11, a negative pressure is formed in the inner tube 5 of the heating tube part 91 first, and then a negative pressure is formed in the inner tube 206 of the atomizer 94 connected to the inner tube 5 with the bushing 230. Further, in this state, the outside air received from the air inlet 209 is accompanied by the electronic cigarette smoke generated in the vicinity of the atomizer heater 205 and enters the heating tube part 91 through the bushing 230. As a result, nicotine and tobacco flavor from the tobacco leaves of the Heat Stick heated by the heater 131 are added to the electronic cigarette smoke, and the electronic cigarette smoke is transferred to the smoker through the filter part of the Heat Stick. In this case, because different types of power are added to the atomizer heater 205 and the heater 131 from the control circuit, it is possible to generate the preferred amount of electronic cigarette smoke and the nicotine and tobacco flavor preferred by the smoker.

Figure 5:
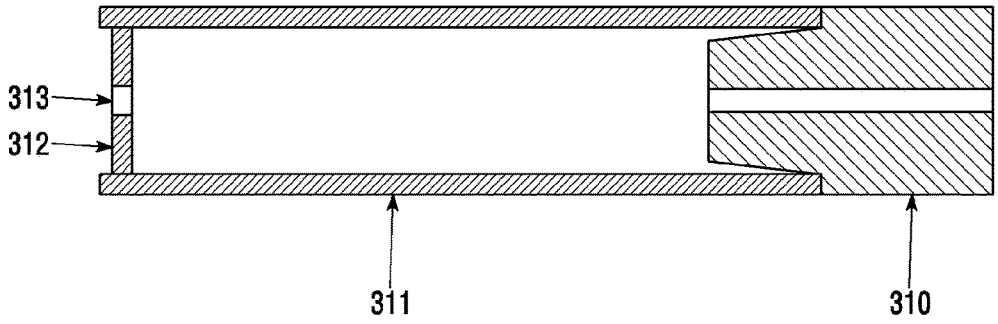
FIG. 5 is an axial cross-sectional view of a tobacco leaf insertion tube and a mouthpiece used by being inserted into the smoking tool according to the present invention.
Figure 6:
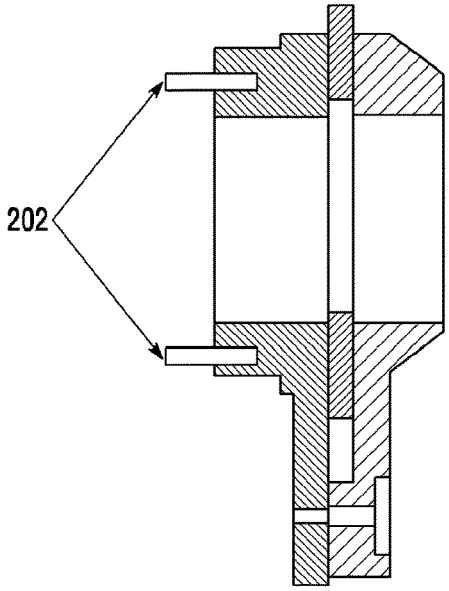
FIG. 6 is an axial cross-sectional view of a tobacco retaining part B of the smoking tool according to the present invention.
Figure 7:
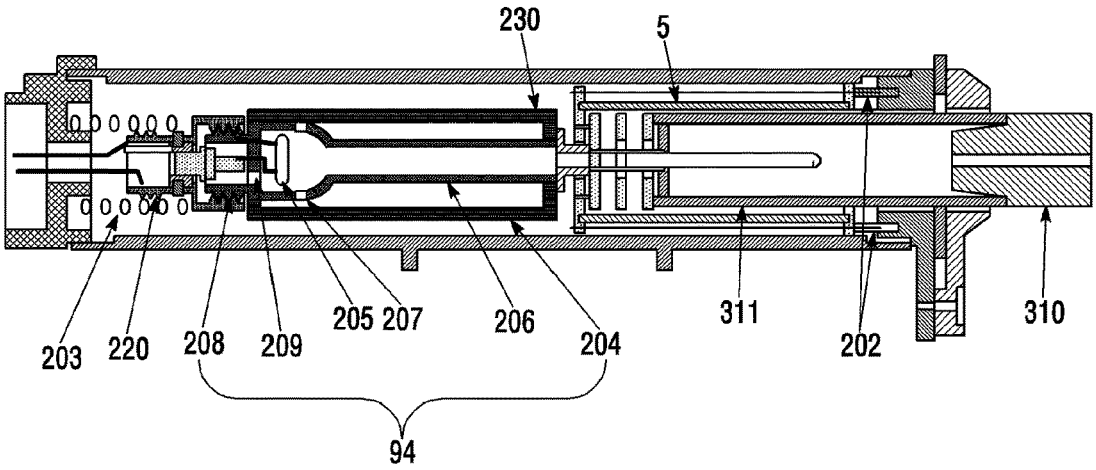
FIG. 7 is an axial cross-sectional view illustrating a state in which the tobacco retaining part B is installed on the configuration of the smoking tool according to the present invention and a tobacco insertion tube and the mouthpiece are inserted into the configuration of the smoking tool.
Figure 9:
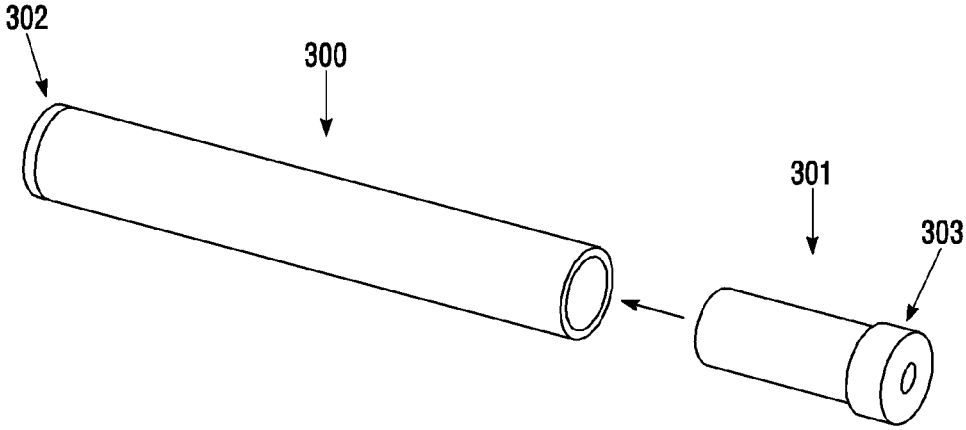
FIG. 9 is a view illustrating a configuration of a Ploom TECH from JT except for a charging part.
Figure 12:
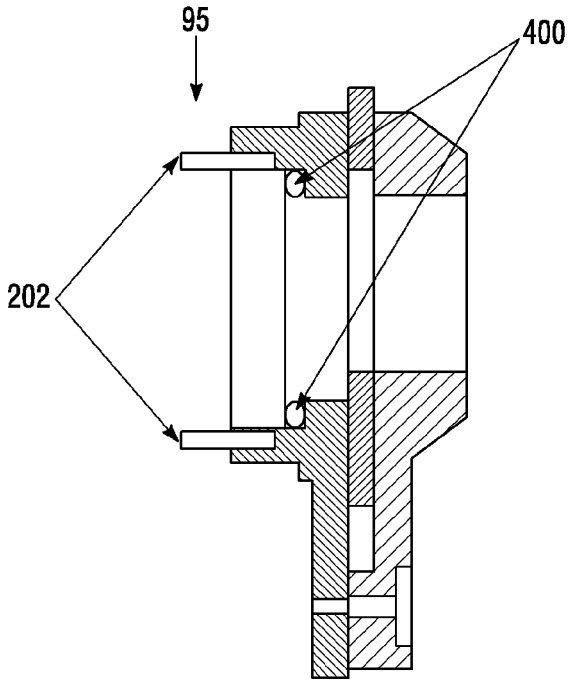
FIG. 12 is an axial cross-sectional view of the tobacco retaining part B of the smoking tool according to the present invention.
Figure 13:
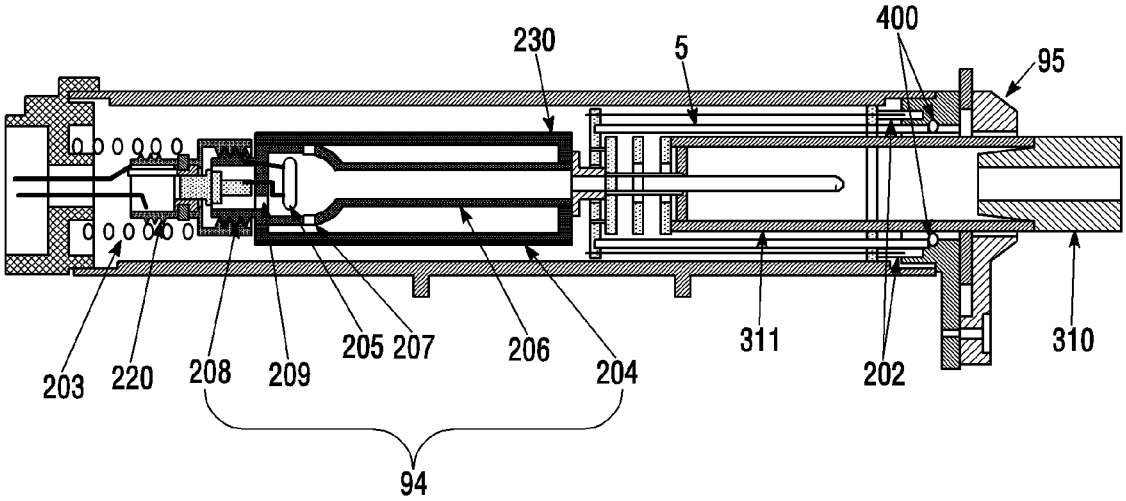
FIG. 13 is an axial cross-sectional view illustrating a state in which the tobacco retaining part B is installed on the configuration of the smoking tool according to the present invention and the tobacco insertion tube and the mouthpiece are inserted into the configuration of the smoking tool.
Figure 15:
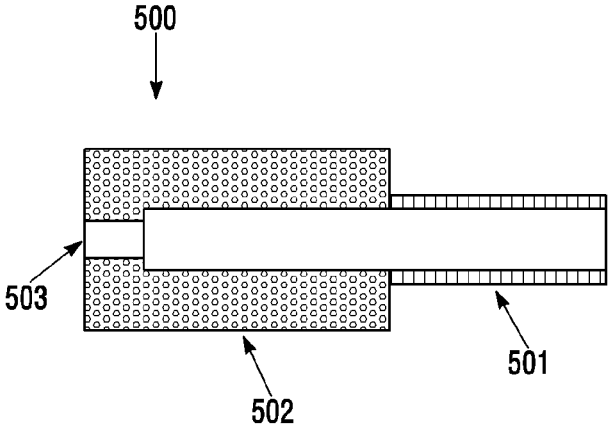
FIG. 15 is an axial cross-sectional view of an air flow restriction component used by being attached to the mouthpiece of the smoking tool according to the present invention.

FIG. 5 is an axial cross-sectional view of the tobacco leaf insertion tube 311 and the mouthpiece 310 used for the smoking tool 100 illustrated in FIGS. 7 and 13 and having the tobacco retaining part B95 illustrated in FIGS. 6 and 12. A tip portion 312 of the tobacco leaf insertion tube 311 has a hole 313 formed at a center thereof, and the heater 131 passes through the hole 313. The tip portion 312 may be made by folding and bending a tip portion of the tobacco leaf insertion tube 311 or manufactured by inserting a metal spacer having a thickness of about 0.5 to 1.0 mm. As the mouthpiece 310, a mouthpiece called a 510-drip tip for a general electronic cigarette is used as it is. Silicone or thermosetting resin is used as a material of the mouthpiece 310. A portion made by cutting, by ⅕, a tobacco part of a typical filter-attached cigarette, which allows the smoker to smoke by burning the tobacco leaves, is inserted into the tobacco leaf insertion tube 311. Alternatively, the tobacco leaf insertion tube 311 is filled with tobacco leaves for a pipe, covered with the mouthpiece 310, and then inserted into the smoking tool 100 having the tobacco retaining part B. The portion made by cutting, by using a cigar cutter, the tobacco part of the typical filter-attached cigarette, which allows the smoker to smoke by burning the tobacco leaves, is inserted into the tobacco leaf insertion tube 311. Alternatively, the tobacco leaf insertion tube 311 is filled with tobacco leaves for a pipe, covered with the mouthpiece 310, and then inserted into the smoking tool 100 having the tobacco retaining part B 95. Further, an insertion portion 501 of an air flow restriction component 500 having a cylindrical shape and illustrated in FIG. 9 or 15 may be inserted into the mouthpiece 310 and then mounted. The hole formed at a center of the mouthpiece has a comparatively large diameter, and a large amount of air flows when the smoker inhales the air. The air flow restriction component 500 serves to restrict the amount of flowing air. That is, it is possible to restrict the amount of flowing air by changing a hole diameter of a hole 503 formed in the tip portion. Further, the quantity of tobacco leaves to be inserted into the tobacco insertion tube 311 may be changed by changing a length of a tube part 502.

When the smoker inhales the air from the mouthpiece 310 in the state illustrated in FIGS. 7 and 13, a negative pressure is formed in the tobacco leaf insertion tube 311 first, a negative pressure is formed in the inner tube 5, and then a negative pressure is formed in the inner tube 206 of the atomizer 94 connected to the inner tube 5 with the bushing 230. Further, in this state, the outside air received from the air inlet 209 is accompanied by the electronic cigarette smoke generated in the vicinity of the atomizer heater 205 and enters the heating tube part 91 through the bushing 230. As a result, nicotine and tobacco flavor from the tobacco leaves heated by the heater 131 are added to the electronic cigarette smoke, and the electronic cigarette smoke is transferred to the smoker through the filter part of the Heat Stick. In this case, because different types of power are added to the atomizer heater 205 and the heater 131 from the control circuit, it is possible to generate the preferred amount of electronic cigarette smoke and the nicotine and tobacco flavor preferred by the smoker. Further, because a difference between an outer diameter of the tobacco leaf insertion tube 311 and an inner diameter of the inner tube 5 is about 0.105 to 0.21 mm cp, the introduction of the outside air from this portion is decreased. Furthermore, because the difference between the outer diameter of the tobacco leaf insertion tube 311 and the inner diameter of the inner tube 5 is about 0.05 to 0.1 mm φ, the introduction of the outside air from this portion is decreased. Further, because an inner diameter of an O-ring 400 is almost equal to the outer diameter of the tobacco leaf insertion tube 311, there is no introduction of the outside air from this portion.

It is necessary to supply a liquid for an electronic cigarette to the atomizer 94 in order to use the smoking tool 100 according to the present invention. In this case, because the spring 203 is used, the atomizer 94 may be pulled in the left direction based on FIGS. 4, 7, 11, and 13. The atomizer 94 may be easily separated from the 510-connector 220 by being rotated in this state. That is, the spring 203 serves to tightly press the atomizer 94 against the heating tube part 91 through the bushing 230 and to easily separate the atomizer.

In the above description, the atomizer 94 and the heating tube part 91 are provided as the different structures. However, it is easily envisaged that the atomizer 94 and the heating tube part 91 may be inserted into a single container, such that the spring is not required and sealability is more assuredly maintained.

The smoking tool according to the present invention is identical to the product called Ploom TECH from JT in that the flavor of the tobacco leaves is added to the electronic cigarette smoke. However, the product does not have the mechanism for heating the tobacco leaves. The amount of nicotine contained in the tobacco, which the smoker is satisfied with, is not evaporated unless the nicotine is heated at a temperature of at least 100° C. or more. Therefore, in the market, the product is considered as being the same type as the electronic cigarette. Different control circuits and heating mechanisms are required to heat the tobacco leaves, and it is apparent that the smoking tool according to the present invention is technologically different from Ploom TECH.

INDUSTRIAL APPLICABILITY

There has been developed the smoking tool in which the atomizer for an electronic cigarette and the tube for heating the tobacco leaves are inserted into the smoking tool, both the atomizer and the tube are structured in an air-tight manner, and the time taken to apply power to the atomizer and the heater and the time taken to apply power to the heater for heating the tobacco leaves are individually controlled, such that it is possible to set a preferred amount of smoke and a preferred nicotine or tobacco flavor and to allow the smoker to enjoy various smoking methods. Furthermore, it is possible for the smoker to smoke by putting tobacco leaves into the tobacco leaf insertion tube, and it is possible to greatly reduce a smoking cost.

What is claimed is:

1. A smoking tool comprising:

a heating tube part into which tobacco material is inserted; and an atomizer configured to generate electronic cigarette smoke using an atomizer heater, wherein the atomizer generates the electronic cigarette smoke when a smoker inhales air, such that the smoker inhales the smoke to which nicotine or tobacco flavor of the tobacco material is added, characterized in, the atomizer comprises:

a container configured to accommodate a liquid for an electronic cigarette, and an inner tube configured to be disposed in the container, accommodate the atomizer heater inside and guide the electronic cigarette smoke to the heating tube part, the inner tube comprises:

an air inlet configured to introduce outside air into the inner tube, and a hole into which the liquid for an electronic cigarette contained in the container is introduced.

2. The smoking tool of claim 1, further comprising a heater configured to heat the tobacco material.

3. The smoking tool of claim 2, further comprising a control circuit configured to apply different powers to the heater and the atomizer heater, in order to adjust an amount of electronic cigarette smoke and the nicotine or tobacco flavor.

4. The smoking tool of claim 2, further comprises a control circuit configured to individually control a time taken to apply power to the heater and a time taken to apply power to the atomizer heater, in order to adjust an amount of electronic cigarette smoke and the nicotine or tobacco flavor.

5. The smoking tool of claim 1, wherein as the atomizer is tightly pressed against a heating tube part by a force of a spring, air does not leak from a connection portion between the atomizer and the heating tube part.

6. The smoking tool of claim 1, further comprising a bushing which is disposed between the atomizer and the heating tube part and is made of heat-resistant resin, in order to prevent heat of the heater of the heating tube part from being transferred to the atomizer.

7. The smoking tool of claim 1, wherein a tip portion of the container is covered with a thermally shrinkable tube.

8. The smoking tool of claim 1, further comprising a switch configured to turn on and off a generation of the electronic cigarette smoke.

9. The smoking tool of claim 1, further comprising a microphone configured to receive a sound that occurs when the smoker sucks the tobacco material, wherein a generation of the electronic cigarette smoke is determined based on the sound received by the microphone.

* * * * *